United States Patent [19]

Tinley

[11] Patent Number: 4,755,920

[45] Date of Patent: Jul. 5, 1988

[54] TRACK LIGHTING FIXTURE RELAMPING SYSTEM

[75] Inventor: Raymond K. Tinley, Mt. Prospect, Ill.

[73] Assignee: Cooper Industries, Inc., Houston, Tex.

[21] Appl. No.: 2,894

[22] Filed: Jan. 12, 1987

[51] Int. Cl.[4] ..... F21V 7/00

[52] U.S. Cl. ..... 362/306; 362/374

[58] Field of Search ..... 362/374, 306, 375, 277, 362/455; 174/51 R, 48; 439/541, 375, 360, 207, 208, 110

[56] References Cited

U.S. PATENT DOCUMENTS

| | | | |
|---|---|---|---|
| 3,096,029 | 7/1963 | Berge | 362/374 |
| 3,283,139 | 11/1966 | Harling | 362/306 |
| 3,358,133 | 12/1967 | Thoman et al. | 362/374 |
| 3,858,042 | 12/1974 | Peterson | 362/374 |
| 4,310,875 | 1/1982 | Price | 362/277 |
| 4,384,319 | 5/1983 | Blaisdell et al. | 362/306 |
| 4,388,679 | 6/1983 | Blaisdell et al. | 362/306 |
| 4,390,935 | 6/1983 | Audesse et al. | 362/306 |
| 4,398,239 | 8/1983 | De Vos et al. | 362/372 |

*Primary Examiner*—Willis R. Wolfe
*Assistant Examiner*—David A. Okonsky
*Attorney, Agent, or Firm*—Eddie E. Scott; Alan R. Thiele; Roger L. Maxwell

[57] ABSTRACT

A track lighting fixture includes a housing with sufficient space for a replaceable lamp and a voltage reduction transformer. Mounted on the base of the housing is a plate member which is removably engagable with the housing by the resilient interaction of spring clips with the housing.

6 Claims, 1 Drawing Sheet

Fig. 1
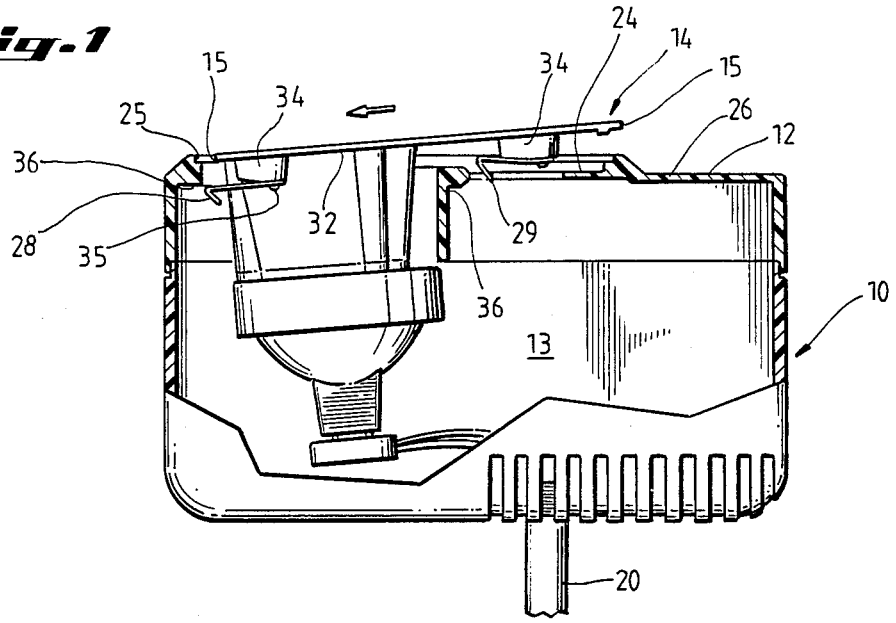
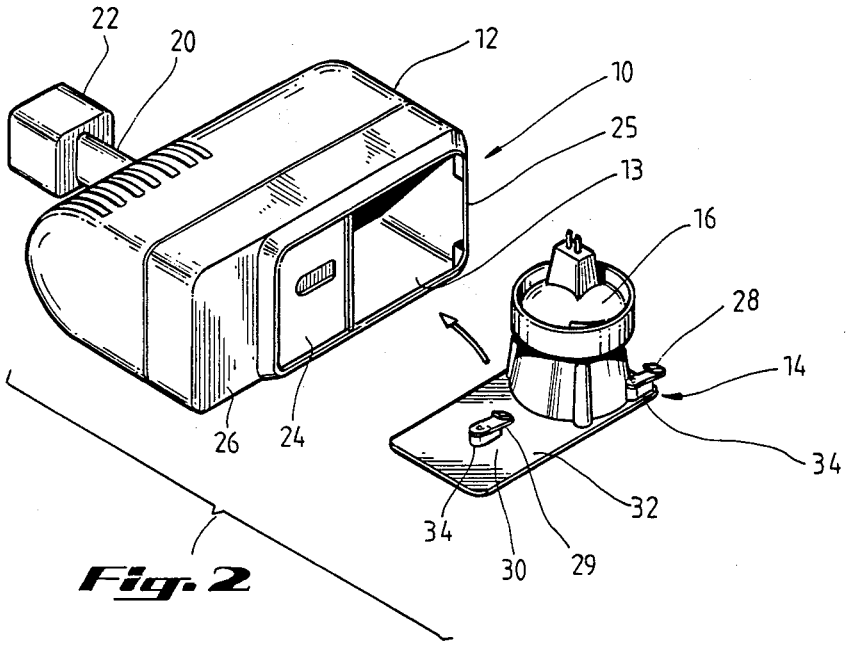
Fig. 2

TRACK LIGHTING FIXTURE RELAMPING SYSTEM

BACKGROUND OF THE INVENTION

This invention relates to track lighting fixtures, more particularly this invention relates to track lighting fixtures wherein the lamp contained therein is easily replaceable.

Track lighting and track lighting systems have become popular in recent years. Such systems include a track which is mounted on a ceiling or a wall and a variety of fixtures which mount physically to and receive power from the mounting track. In order to provide a variety of fixtures and unique lighting effects, it has been discovered that the use of small lights, such as those associated with a 12 volt system, may be used in the place of lamps requiring normal household or 120 volt current. the small 12 volt lamps require the use of a transformer to step down the 120 volts to 12 volts. Consequently, a transformer is typically located within the housing of the track lighting fixture next to the lamp itself.

In many prior art installations the transformer and replaceable lamp are co-located on a base plate which is rigidly affixed to a housing. In order to change the lamp in the track lighting fixture, it is required to undo several mechanical fasteners. Such work requires the use of additional tools and oftentimes dismounting the fixture from the track. Such dismounting is particularly inconvenient if the fixture has ben adjusted to position the emitted light on a certain object in a particular way.

There is therefore a need in the art to provide a convenient system for relamping a track lighting fixture which does not require the use of additional or special tools, dismounting of the track fixture from the track or the use of a series of complex steps to effect relamping of the fixture. Such a system should be easy to manufacture, low in cost and usable by a homeowner or businessman having little to no experience in the maintenance and care of track lighting fixtures.

SUMMARY OF THE INVENTION

A track lighting fixture includes a housing which includes a space for a replaceable bulb and a voltage reduction transformer. The bottom of the housing is adapted to mount a plate upon which the replaceable bulb is affixed. The plate is characterized by having a plurality of resilient clip members on one end and a single resilient clip member located on its central portion. When it is desired to replace the bulb within the track lighting fixture, the plate member is simply pulled away from the housing, the bulb is replaced and the plate member is replaced on the housing. Replacement on the housing is accomplished by engaging the pair of clip members located on one end of the plate member with bosses formed on the inside of the housing and then pivoting the plate member against these bosses so that the clip member located in the central portion of the plate member engages an opening formed in the bottom on the housing.

BRIEF DESCRIPTION OF THE DRAWINGS

A better understanding of the present invention may be had by reference to the drawings wherein:

FIG. 1 is a cross-sectional side view of the track lighting fixture of the present invention, and FIG. 2 is a perspective view of a disassembled track lighting fixture shown in FIG. 1.

DESCRIPTION OF THE EMBODIMENTS

As may be seen by reference to FIGS. 1 and 2, the track lighting fixture 10 of the present invention consists of two parts. These two parts are housing 12 and bottom plate assembly 14. Housing 12 is designed so that it has sufficient space therein for the mounting of a replaceable lamp and a voltage reduction transformer (not shown). The voltage reduction transformer is required because the size lamp used with this type of fixture is a low voltage type and requires a reduction from line voltage in order to operate.

Projecting from the back of fixture 10 is connecting arm 20 which terminates in a connection 22 for mounting and providing electrical contact with mounting track (not shown). Housing 12 is further characterized by having a recess 24 formed on its bottom 26. This recess 24 provides for mounting of bottom plate assembly 14.

Bottom plate assembly 14 is characterized by a provision for mounting of the replaceable lamp 16 and a plurality of resilient clip members 28 and 29. Clip members 28 and 29 are located in two locations with respect to plate assembly 14. A set of clip members 28 is located at one end of the plate assembly 14 and another clip member 29 is located in central portion 30 of plate assembly 14. Clip members 28 and 29 may be located on bosses 34 which are formed on the inward facing side 32 of plate assembly 14 so as to elevate the clip members 28 and 29 away from the inward facing side 32 of plate assembly 14. Clip members 28 and 29 are located such that they will engage clip engagement surfaces 36 formed on the inside of housing 12. Any suitable attachment means such a welding, riveting or fasteners may be used to secure clip members 28 and 29 to bosses 34. In the preferred embodiment described a threaded fastener 35 is used.

OPERATION OF THE DEVICE

A further understanding of the operation of the track light relamping system of the present invention may be understood by reference to FIG. 1. Therein it is shown that replaceable lamp 16 and bottom plate assembly 14 are inserted into a space in housing 12. The forward set of clips 28 are engaged with the clip engagement surfaces 36 formed on the inside 13 of housing 12. Attachment of bottom plate assembly 14 to housing 12 is accomplished by slightly tilting bottom plate assembly 14 at an angle with respect to housing 12. This slight tilting permits resilient clip members 28 to ride over surfaces 36 which formed on inside 13 of housing 12. Bottom plate assembly 14 is then moved forward so as to engage corner 15 of the bottom plate assembly 14 with the front wall 25 of recess 24. Once this has been accomplished, bottom plate assembly 14 is pushed toward housing 12. This causes resilient clip member 28 in the central portion 30 of plate assembly 14 to enter housing 12. Resilient clip member 29 continues to pass into housing 12 until it comes to rest on the clip engagement surface 36 formed in the midst of housing 12. This action causes the rear corner 15 of plate assembly 14 to fall flush into recess 24.

The removal of bottom plate assembly 14 from housing 12 is accomplished by reversing the foregoing steps. Specifically, plate assembly 14 is pulled away from housing 12 by pulling it rearward and outward at an angle. Such motion causes resilient clip member 29 located in central portion 30 of plate assembly 14 to become initially disengaged followed by clip members 28 located at the forward end of plate assembly 14 becoming similarily disengaged. Once clip members 28 and 29 have been disengaged from housing 12, plate assembly 14 may be removed and lamp 16 replaced.

There is thereby provided by the relamping system of the present invention a method for replacing burned out lamps in track lighting fixtures which does not require the use of special tools or a series of complex steps. The disclosed system is easy to manufacture and low in cost. While the invention has been described with a certain degree of particuarlity, it is manifest that many changes may be made in the details of construction without departing from the spirit and scope of this disclosure. It is understood that the invention is not limited to the embodiments set forth herein for purposes of exemplification, but is limited only by the scope of the attached claim or claims, including the full range of equivalency to which each element thereof is entitled.

I claim:

1. A track lighting fixture comprising:

an elongated housing containing a space for a replaceable bulb and a voltage reduction transformer;

a substantially flat plate member engageable with the underside of said elongated housing, said substantially flat plate member containing means for mounting said replaceable bulb;

a plurality of resilient clip members located at one end of said plate member, said clip members being engageable with said elongated housing;

at least one resilient clip member located in the midst of said substantially flat plate member, said resilient clip member being engageable with said elongated housing;

whereby when said clip members engage said elongated housing, said substantially flat plate member lies flat against said elongated housing.

2. The track lighting fixture as defined in claim 1 further including surfaces located within said elongated housing, said surfaces constructed and arranged to engage said resilient clip members.

3. The track lighting fixture as defined in claim 2 wherein said resilient clip members are mounted on bosses.

4. The track lighting fixture as defined in claim 1 wherein said elongated housing includes a recess constructed and arranged to contain said substantially flat plate member when said substantially flat plate member is affixed to said elongated housing by said resilient clip members.

5. A method of relamping a track lighting fixture having an elongated housing and a substantially flat plate for mounting a replaceable lamp, said method comprising the steps of:

pulling said substantially flat plate member away from said elongated housing;

replacing said lamp;

engaging said resilient clip members located on one end of said substantially flat plate member with said elongated housing;

engaging a clip member located in the central portion of said substantially flat plate member with said elongated housing;

pressing said substantially flat plate member toward said elongated housing.

6. A replaceable lamp assembly for use with a track lighting fixture having an elongated housing comprising:

a substantially flat plate member;

means for mounting a replaceable lamp on said substantially flat plate member;

a plurality of resilient clip members located at one end of said substantially flat plate member;

at least one resilient clip member located in the midst of said substantially flat plate member;

said clip members being constructed and arranged to releasably mount said substantially flat plate member to said elongated housing.

* * * * *